United States Patent [19]

Scharton et al.

[11] Patent Number: 4,655,846

[45] **Date of Patent: * Apr. 7, 1987**

[54] METHOD OF PRESSURE PULSE CLEANING A TUBE BUNDLE HEAT EXCHANGER

[75] Inventors: Terry D. Scharton, Santa Monica; George B. Taylor, Culver City, both of Calif.

[73] Assignee: Anco Engineers, Inc., Culver City, Calif.

[ * ] Notice: The portion of the term of this patent subsequent to Feb. 24, 2004 has been disclaimed.

[21] Appl. No.: 742,134

[22] Filed: Jun. 6, 1985

Related U.S. Application Data

[63] Continuation of Ser. No. 486,352, Apr. 19, 1983, abandoned.

[51] Int. Cl.[4] ..... B08B 3/12; B08B 5/00; B08B 9/02

[52] U.S. Cl. ..... 134/1; 15/1; 134/17; 134/22.12; 134/22.18; 134/37; 165/95; 376/316

[58] Field of Search ..... 134/1, 10, 17, 21, 22.12, 134/22.18, 37; 165/95; 15/316 R, 404, 406, 1; 376/310, 316

[56] References Cited

U.S. PATENT DOCUMENTS

| | | | |
|---|---|---|---|
| 2,351,163 | 6/1944 | Thomas | 134/1 X |
| 3,409,470 | 11/1968 | Karpovich | 134/17 X |
| 3,420,758 | 1/1969 | Scheer | 134/1 X |
| 3,457,108 | 7/1969 | Hittel | 134/17 X |
| 3,517,674 | 6/1970 | Allen et al. | 134/1 |
| 3,687,369 | 8/1972 | Johnstone | 134/1 X |
| 3,916,844 | 11/1975 | Cassell | 376/316 X |
| 4,320,528 | 3/1982 | Scharton et al. | 376/310 |
| 4,359,962 | 11/1982 | Olsson et al. | 134/1 X |
| 4,366,003 | 12/1982 | Korte et al. | 165/95 X |
| 4,390,034 | 6/1983 | Bes | 134/104 |
| 4,396,434 | 8/1983 | Forster | 134/1 |
| 4,407,236 | 10/1983 | Schukei et al. | 165/95 X |
| 4,492,186 | 1/1985 | Helm | 165/95 X |

FOREIGN PATENT DOCUMENTS

| | | | |
|---|---|---|---|
| 7901019 | 11/1979 | PCT Int'l Appl. | 134/1 |

*Primary Examiner*—Ivars Cintins
*Assistant Examiner*—W. Gary Jones
*Attorney, Agent, or Firm*—Thomas I. Rozsa

[57] ABSTRACT

The present invention relates to an improved method of cleaning a tube bundle heat exchanger by removing the buildup of sedimentation or "sludge" which accumulates in the bottom or at other elevations of a heat exchanger vessel through utilization of a repetitive shock wave induced in the liquid layer above the sludge. The shock waves are induced by air-gun type pressure pulse shock wave sources or pressurized gas-type pressure pulse shock wave sources. The shock wave serves to effectively and safely loosen the products of corrosion and other elements which settle at the bottom of the heat exchanger or steam generator and thereby facilitates their easy removal through flushing and vacuuming the vessel.

80 Claims, 2 Drawing Figures

METHOD OF PRESSURE PULSE CLEANING A TUBE BUNDLE HEAT EXCHANGER

This is a continuation of co-pending application Ser. No. 06/486,352 filed on 4/19/83 now abandoned.

BACKGROUND OF THE INVENTION

1. Field of the Invention

The present invention relates to an improved method of cleaning a nuclear steam generator or the other tube bundle heat exchanger by removing the buildup of sedimentation or "sludge" which accumulates in the bottom of a heat exchanger vessel through utilization of a repetitive shock wave induced in the sludge and in flushing fluid. The shock wave serves to effectively and safely loosen the products of corrosion and other elements which settle at the bottom of the heat exchanger or steam generator and thereby facilitates their easy removal through flushing and vacuuming the vessel.

2. Description of the Prior Art

One of the major components in a power generating facility such as a nuclear power plant is the steam generator or heat exchanger portion of the facility. Large scale heat exchanger systems are essentially comprised of a primary system which contains a large number of individual tubes which have fluid circulating through them and a secondary system which consists of a second fluid surrounding said tubes contained within a housing which enwraps both systems. Heat is transferred from the fluid running through these heat exchanger tubes to the fluid in the secondary system which is itself eventually turned to steam. The steam, in turn, generates power.

These heat exchangers or steam generators have experienced many problems due to the buildup of products of corrosion, oxidation, sedimentation and comparable chemical reactions within the heat exchanger. The problem of magnetite buildup at the junctions of the primary heat exchanger tubes and the support plates for those tubes, and further magnetite buildup within the crevices between the tubes and their support plates was extensively treated in U.S. Pat. No. 4,320,528. That patent addressed the use of ultrasonic methods to facilitate the removal of the magnetite from those junctions. The present inventors are the same as the inventors in U.S. Pat. No. 4,320,528.

At the bottom of the heat exchanger vessel is a tube sheet. This is thick metal plate which acts as the support base for numerous heat exchanger tubes. In addition to the problems of magnetite buildup at the junctions and inside the crevices of the primary heat exchanger tubes and their support plates, a second problem has also troubled steam generators for many years. There is a buildup of sedimentation or "sludge" which accumulates in the bottom of heat exchanger vessels. This sludge includes copper oxide, magnetite and other oxidation or corrosion products which have not adhered to the tubing or other surfaces and therefore accumulate at the bottom. The sludge pile rests on top of the tube sheet and on top of the higher elevation support plates and may form a thick layer. The sludge further accumulates in the crevices between the tube sheet and the primary heat exchanger tubes which are embedded in the tube sheet for support and also accumulates on the tube support plates. The problem of removing the sludge which enters the deep crevices in the tube sheet was addressed in presently pending patent application Ser. No. 06/370,826 filed on 4/22/82. Patent application Ser. No. 06/370,826 solves the problem of removing sludge from the deep crevices through use of specialized ultrasonic waves which are directed in a certain way to produce the desired result.

In addition to the above two prior art references, the following prior art patents address the problem of cleaning a nuclear steam generator or else keeping it clean before it becomes dirty through the use of ultrasonics:

1. U.S. Pat. No. 2,664,274 issued to Worn et al.
2. U.S. Pat. No. 2,987,086 issued to Branson.
3. U.S. Pat. No. 3,033,710 issued to Hightower et atl.
4. U.S. Pat. No. 3,240,063 issued to Sasaki et al.
5. U.S. Pat. No. 3,295,596 issued to Ostrofsky et al.
6. U.S. Pat. No. 3,433,669 issued to Kouril.
7. U.S. Pat. No. 3,428,811 issued to Harriman et al.
8. U.S. Pat. No. 3,447,965 issued to Teumac et al.
9. U.S. Pat. No. 3,854,996 issued to Frost et al.
10. U.S. Pat. No. 4,120,699 issued to Kennedy et al.
11. U.S. Pat. No. 4,167,424 issued to Jubenville et al.

All of the above referenced patents have been extensively discussed in both U.S. Pat. No. 4,320,528 or else in presently pending patent application Ser. No. 06/370,826 filed on 4/22/82. The following two prior art publications have also been discussed in these references:

1. Chemical Cleaning of BWR and Steam Water system at Dresden Nuc. Pw. Station, Obrecht et al., pp 1–18, (10/26/60) 21st Ann. Conf. of Eng.
2. Special Tech. Pub. 42 (1962) ASTM Role of Cavitation in Sonic Energy Cleaning, by Bulat.
3. R & D Status Report Nuclear Power Division, which appeared on pages 52 through 54 of the April 1981 issue of the EPRI Journal. The Article was by John J. Taylor.

The buildup of sludge on the tube sheet and upper tube support plates degrades the heat transfer process from the fluid in the primary system to the fluid in the secondary system, and may also restrict secondary fluid flow as well as producing a stagnant zone which enhances corrosion of the tubes, tube sheet and support plates. As addressed in patent application Ser. No. 06/370,826, the sludge which enters crevices within the tube sheet creates further problems and serves to damage the heat exchanger tubes. As a result, it is very important to clean the heat exchanger or steam generator to effectively remove the sludge from the surface of the tube sheet. All of the prior art discussed above employs the use of ultrasonics. While the methods discussed in the prior art, especially those in U.S. Pat. No. 4,320,528 and application No. 06/370,826, are very effective and valuable, the requirement of using ultrasonics has several significant disadvantages. First, in order to generate the ultrasonic waves, expensive transducers must be used. This requires considerable effort and expense to bring the ultrasonic transducers to the site of the steam generator and then putting them in their proper place at the location of the steam generator. Second, in order to achieve an effective level of ultrasonic waves, it is often necessary to cut away a portion of the steam generator wall and put the face of the transducer at the location of the cut away portion. Many owners of the power plant which incorporates a steam generator are very reluctant to have a portion of the wall cut away and then later welded back in place after the steam generator has been cleaned.

A third problem which arises with prior art applications is the use of corrosive chemicals to assist in the cleaning operation. While the chemicals serve to clean and remove the sludge, they also serve to eat away at the various components of the steam generator. Therefore, it is desirable to find a method of cleaning which does not require the use of corrosive chemicals. One method known in the prior art is called water lancing. This is in effect the use of a jet of water which is shot into the sludge pile for the purpose of loosening the sludge. There are some problems with this water lancing process. The loosening process is not very effective because it is difficult to penetrate to the interior of the tube bundle and in addition there may be a problem of using the jet of water to impinge against the heat exchanger tubes at that location. The jet of water might cause sludge particles to reflect onto and then off the heat exchanger tubes, thereby possibly resulting in damage to these tubes.

Therefore, although the use of ultrasonics combined with chemicals and the use of a jet of water are all known in the prior art for cleaning and removing sludge at the bottom of a heat exchanger or steam generator, none of these methods can be employed without the significant problems discussed above. At present, there has been no prior art method for effectively removing the sludge through very quick, inexpensive method which does not require the use of chemicals or the cutting away of a portion of the steam generator.

SUMMARY OF THE PRESENT INVENTION

The present invention relates to an improved method of cleaning a nuclear steam generator or other tube bundle heat exchanger by removing the buildup of sedimentation or "sludge" which accumulates in the bottom or on top of higher elevation support plates of a heat exchanger vessel through utilization of a repetitive shock wave induced in the sludge. The shock wave serves to effectively and safely loosen the products of corrosion and other elements which settle at the bottom of the heat exchanger or steam generator and thereby facilitates their easy removal through flushing and vacuuming the vessel.

It has been discovered, according to the present invention, that if a source of high energy is used to generate a shock wave or pressure pulse which is directed into the sludge pile, either directly or else into a level of water above the sludge pile, the shock wave will impinge upon the sludge, agitate it and loosen it, and will thus permit the sludge to remain in suspension from which it can be removed by a subsequent water flushing and vacuuming operation.

It has also been discovered, according to the present invention, that the use of a shock wave to loosen the sludge permits the operation to be effectively achieved without the use of corrosive chemicals which might damage the components of the steam generator.

It has also been discovered, according to the present invention, that the use of a pressure pulse or shock wave can also be used in conjunction with chemial solvents, if desired, to remove heavily encrusted materials such as magnetite from various locations within the steam generator.

It is therefore an object of the present invention to provide a method for quickly and efficiently loosening the products of oxidation and corrosion which settle on top of the tube support plate at the bottom of a steam generator as well as on the tube support plates at higher elevations.

It is another object of the present invention to provide a method for providing such pressure pulses or shock waves which can be utilized with existing steam generator or tube bundle heat exchanger facilities and which will not require the cutting away of steam generator walls to fit the pressure source into the vessel wall.

It is another object of the present invention to provide a method of cleaning the sludge pile which can be used without corrosive chemicals but which also can be used in conjunction with corrosive chemicals if desired.

It is a further object of the present invention to provide a method for cleaning the steam generator which can use either a gaseous source, a liquid source or an electrical source of generating the pressure pulse which is used to agitate and loosen the sludge and keep it in suspension.

Further novel features and other objects of the present invention will become apparent from the following detailed description, discusson and the appended claims taken in conjunction with the drawings.

DRAWING SUMMARY

Referring particularly to the drawings for the purpose of illustration only and not limitation, there is illustrated:

DETAILED DESCRIPTION OF THE PREFERRED EMBODIMENT

Figure 1:
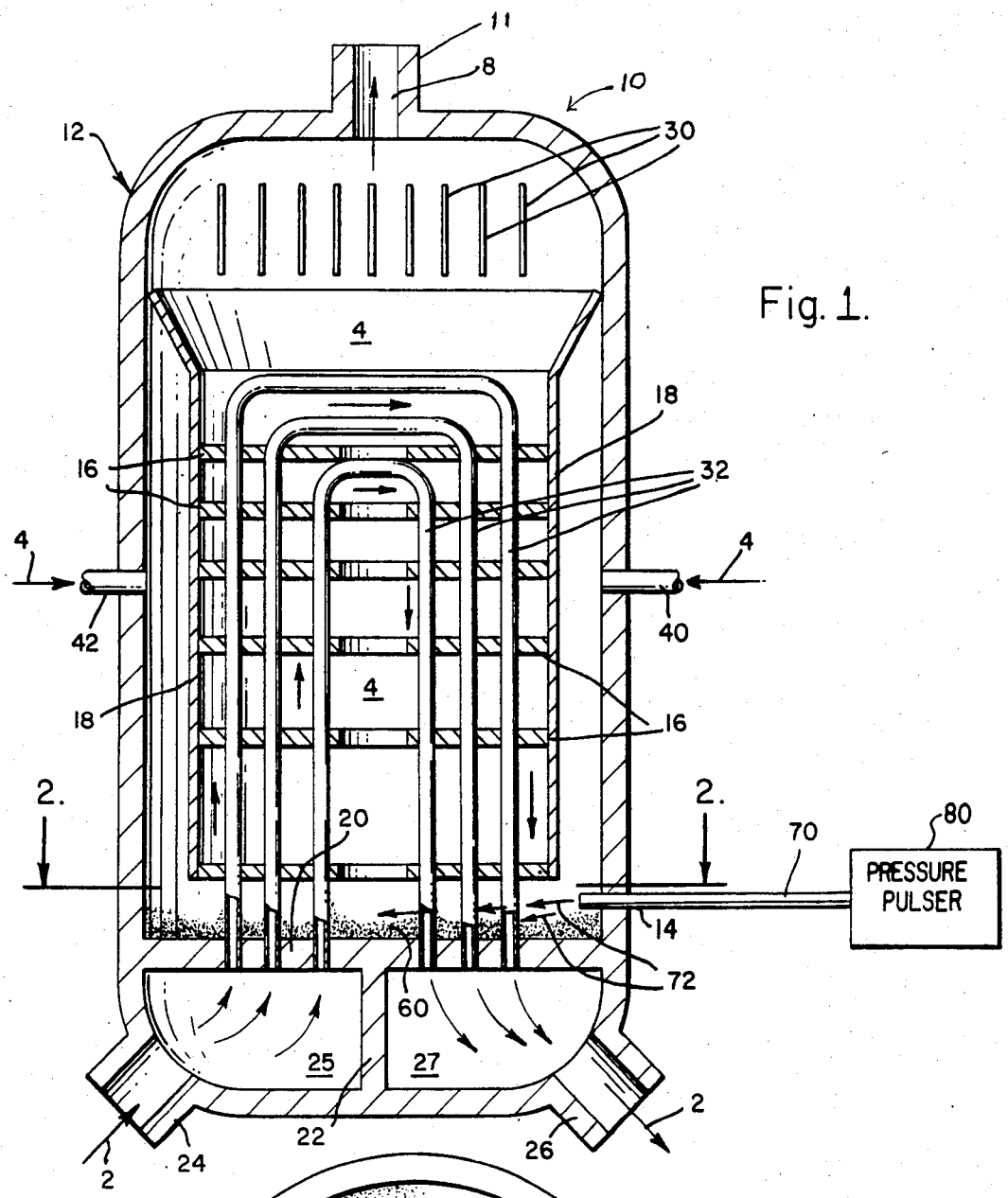
FIG. 1 is a side sectional view of a typical heat exchanger or steam generator which contains a tube bundle through which the primary fluid is circulated.

With reference to the drawings of the invention in detail and more particularly to FIG. 1, there is shown at 10 a heat exchanger or steam generator. The external shell or envelope 12 of said steam generator 10 is a pressure vessel. In this external shell 12 are a large number of heat exchanger tubes 32. At the base of the heat exchanger tubes 32 is the support tube sheet 20.

At the base of the steam generator 10 is a primary entrance nozzle 24 which leads to the entrance chamber 25 located directly below the tube sheet 20. On the opposite side of the heat exchanger 10 is the exit chamber 27 and the primary exit nozzle 26. The exit chamber 27 is also located directly below the tube sheet 20. The entrance chamber 25 and the exit chamber 27 are separated by a metal wall 22.

Initially, a secondary fluid 4 enters the heat exchanger or steam generator 10 through secondary entrance inlets 42 and 40 located in the external shell 12. The secondary fluid 4 fills the steam generator 10 and surrounds the heat exchanger tubes 32.

In normal operation, the primary fluid 2 comes from a heat source such as a nuclear reactor and enters said steam generator 10 through the primary entrance nozzle 24. The fluid enters into the entrance chamber 25 and is forced through the heat exchanger tubes 32 and up through the steam generator or heat exchanger 10. The heat exchanger 10 illustrated in FIG. 1 is of the U-bend type, where the primary heat exchanger tubes 32 run most of the length of the steam generator or heat exchanger 10 and are bent at the top to form a U-shaped configuration. Upon reaching the uppermost portion of the primary heat exchangers tubes 32, the primary fluid 2 starts back down the opposite side of the primary heat exchanger tubes 32, goes into the exit chamber 27 and exits the heat exchanger 10 through primary outlet nozzle 26.

Heat which is carried by the primary fluid 2 is transferred to the secondary fluid 4 while the primary fluid 2 is circulating through heat exchanger tubes 32. Sufficient heat is transferred to the secondary fluid 4 so that the primary fluid 2 leaving the exit nozzle 26 is at a substantially lower temperature than it was when it entered the heat exchanger through nozzle 24. The secondary fluid 4 absorbs heat carried by the primary fluid 2 and said secondary fluid 4 becomes steam 8 during the heat absorption process. Said steam 8 passes through separators 30 which remove excess moisture from said steam 8, and then exits through steam outlet 11 at the top of the heat exchanger or steam generator 10. The high pressure steam 8 can then be used to drive a turbine.

The primary fluid 2 can be water. A gas such as helium or another liquid such as liquid sodium can also be used for the primary fluid. The secondary fluid is usually water.

During the process described above, a large amount of moisture and heat is generated within the steam generator 10. This leads to corrosion of various portions of the steam generator 10. Some of the corrosion remains on the metal, especially at the juncture of the primary heat exchanger tubes 32 and their support plates 16. This problem was addressed by the present inventors in their U.S. Pat. No. 4,320,528. Much of the corrosion and other chemical reactions do not remain on the metal but instead settle at the bottom of the steam generator 10 and on the top of the upper support plates 16. There is created a buildup of sedimentation or "sludge" which accumulates at the bottom of the heat exchanger vessel and on the support plates. This sludge, shown as 60 in FIG. 1 and FIG. 2 includes copper oxide, magnetite, and other oxidation or corrosion products which have not adhered to the tubing or other surfaces and therefore accumulate at the bottom.

Reference to FIG. 1 shows the sludge pile 60 which rests on the tube sheet 20 and surrounds the exposed lower portion of the primary heat exchanger tubes 32. The presence of sludge 60 not only affects the rate of flow of the secondary fluid 4, but also degrades the heat transfer process from the fluid in the primary system to the fluid in the secondary system. As the sludge layer deepens, the lowermost portion of the vessel becomes only marginally useful as a heat exchanger.

The use of ultrasonics to remove most of the sludge 60 was addressed by the present inventors in their U.S. Pat. No. 4,320,528. In that patent, transducers are placed around the circumference of the metal wrapper 18 at the level of the sludge pile 60 and the heat exchanger 10 is filled with an appropriate chemical solvent which covers the sludge pile. The transducers are then activated and the combined effect of chemical solvent and transverse sonic energy serves to agitate, loosen, and dissolve the sludge pile. Ultrasonic cleaning is most effective when used in conjunction with a chemical solvent. Steam generator owners are reluctant to introduce chemical solvents into their generators. In addition, the use of a lot of transducers can be both expensive and cumbersome to install.

It is therefore the primary desire of the present invention to create a method of removing the sludge 60 which does not require the use of ultrasonics and their associated transducers and which will work with only water as the solvent. The general idea of the present invention is to use an "air gun" device to clean and remove the corrosion deposits from a nuclear power plant steam generator or other tube bundle heat exchanger. The concept is to induce a repetitive shock wave within a fluid layer on top of sludge 60 to thereby provide agitation which will loosen the sludge 60 and thereby permit it to be easily removed through a subsequent flushing operation.

Typically, the sludge pile 60 consists of a layer which can be a fraction of an inch to several feet thick of loose iron and copper metals and oxides of granular structure which is comparable to loose sand. One application of the present invention is to use an air gun consisting of a high pressure air source which for example can be 2000 psi, modulated by a sharp rise-time value at a repetition of 1 Hertz to repeatedly introduce shock waves and pressure fluctuations in the fluid layer above and in the sludge pile 70. The repetitive shock waves will loosen the sludge 60 and move it across the base of the steam generator 10, where it may be removed by a subsequent flushing and vacuuming operation. In the preferred embodiment, the sludge pile is covered with a level of water or other fluid 4, for example to a height of approximately twelve (12) inches above the sludge pile 60. The shock wave is then introduced into the water or other fluid 4 which then transmits the shock wave to the sludge pile 60. An ultrasonic wave which was used in prior art applications is a wave of high frequency whose primary purpose was to induce cavitation. The high frequency ultrasonic waves have short wavelengths, low amplitudes and therefore low energy. In contrast, the concept of the present invention is to use a pressure pulse shock wave which is generated from a very intense and powerful compact source and is enhanced by frequent repetitions. The shock wave which is thereby produced is of lower frequency but of much higher energy which therefore can create a larger wavelength and a correspondingly larger movement on objects which it impacts. The pressure pulse spherical shock wave therefore moves across either the water above the sludge pile or else across the sludge pile in a discontinuous fashion, to thereby loosen up the sludge.

Figure 2:
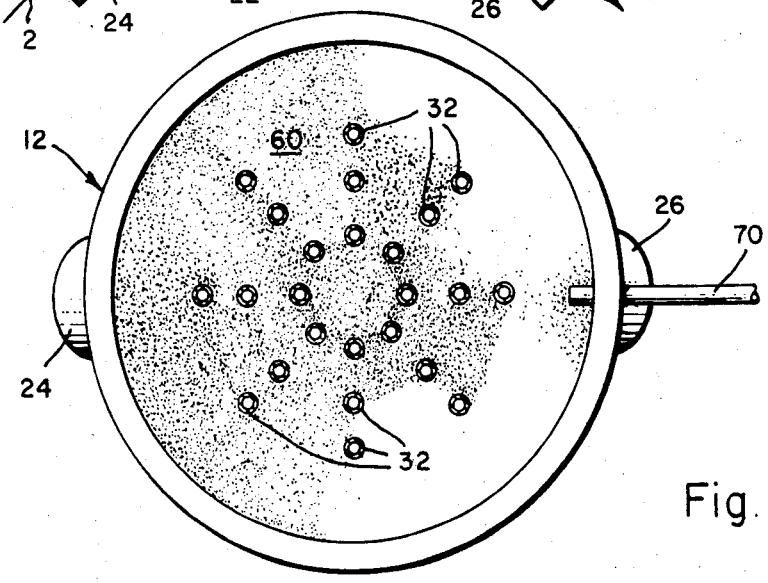
FIG. 2 is a cross-sectional view of the heat exchanger or steam generator, taken along line 2—2 of FIG. 1.

Having thus described the concept of the present invention, one embodiment to produce the above result is illustrated in FIG. 1 and FIG. 2. In most embodiments, the outer shell 12 of the steam generator has a series of small holes which are known as "hand holes" located near its lower portion and near the support tube sheet. These holes can be anywhere from approximately 1 to 6 inches in diameter. Also, manways, drain and vent lines can be used if available. One such hole is shown at 14 in FIG. 1. It will be appreciated that a conventional steam generator may contain any multiplicity of such holes which are located around the circumference of outer shell 12 or else can be located in several vertical rows along the outer shell. While only one such hole 14 is shown in FIG. 1, it will be appreciated that any multiplicity of such holes 14 can be located around the circumference of the steam generator 10, in one or more vertical rows.

A Pressure Pulse Shock Wave Source 80 is located outside of the steam generator 10 and in alignment with a corresponding one of said hand holes 14. In some embodiments, the Pressure Pulse Shock Wave Source 80 can be fit directly into a hand hole 14. In other embodiments, as shown in FIG. 1, an Interface Means 70 joins the Pressure Pulse Shock Wave Source 80 to the hand hole 14. While only one Pressure Pulse Shock Wave Source 80 and associated Interface Means 70 is shown in FIG. 1, it will be appreciated that the scope of the present invention encompasses the utilization of any multiplicity of Pressure Pulse Shock Wave Sources 80 with or without associated Interface Means 70 located either adjacent one another in associated adjacent hand holes 14 or else in spaced locations around the circumference of the outer shell 12 either all in the same vertical row or else in various vertical rows. Alternatively, the Pressure Pulse Shock Wave Source 80 can be located inside the steam generator 10 and can be placed in any position inside the steam generator 10, utilizing hand holes, manways, drain lines, and vent lines. In some cases it may be desirable to locate the sources in lanes or spaces interior to the tube bundle which are accessible from the shell penetrations. Also, more than one source 80 can be used inside and adjacent to the heat exchanger 10. Also, sources may be located at higher elevations with the fluid layer level raised appropriately to immerse them.

The preferred method of the present invention is as follows. A multiplicity of Pressure Pulse Shock Wave Source 80 is placed around the circumference of the shell 12, with one Pressure Pulse Shock Wave Source 80 placed into an associated one hand hole 14. Where applicable depending on the type of Pressure Pulse Shock Wave Source 80 used, an Interface Means 70 connects the Pressure Pulse Shock Wave Source 80 into the hand hole 14. The sludge pile 60 is covered with a liquid medium such as water 4, to a depth of approximately twelve inches above the sludge pile. It will be appreciated that other water levels, both greater than or less than 12 inches are certainly within the spirit and scope of the present invention. The liquid such as water 4 can be placed into the steam generator 10 through other hand holes, manways and penetrations in the shell 12. The Pressure Pulse Shock Wave Sources 80 are then activated to emit a very intense and powerful shock wave 72 which is transmitted directly into the liquid 4 above the sludge pile 60. The shock wave which for example can be a spherical shock wave is transmitted from the liquid 4 to the sludge pile 60 and serves to impinge upon the sludge pile 60, agitate it, and loosen the encrusted sludge 60.

In the preferred embodiment, one or a multiplicity of Pressure Pulse Shock Wave Sources 80 emit a higher pressure shock wave at a pressure ranging from 50 to 5000 pounds per square inch (psi). The Pressure Pulse Shock Wave Sources 80 contain a valve which can be rapidly and repeatedly opened and closed to provide the pressure pulses. By way of example, the valve can be opened and closed approximately once each second. On a scale of pressure versus time, it is preferable to create a shock wave which produces a pressure level range of approximately 1/100th to 100 Bars of Pressure at 1 Meter. A desirable pressure scale is illustrated in FIG. A 17 of the technical paper OTC 4255, "Marine Seismic Energy Sources" Acoustic Performance Comparison" by Roy C. Johnston, ARCO Oil & Gas Co., and Byron Cain, Geophysical Service Inc. It will now be appreciated why in the preferred embodiment the sludge pile should be covered with a layer of water or other liquid. Due to the intense pressure created, it is necessary to have the liquid layer over the sludge to act like a cap to help absorb the strength of the shock. The frequency of the shock waves produced can range from approximately 0 Hertz to 1000 Hertz. The effect, therefore, is to tear a hole in the water, then into the sludge, impinge upon the sludge, agitate it and loosen it, and then allow it to remain in suspension from which it can be removed. While the pressure source is in action to keep the sludge in suspension, the steam generator 10 is continuously flushed with water to remove the sludge. Manways, hand holes or other penetrations in the shell 12 are used to provide inlets and exits for this flushing. The flushing water is filtered outside the heat exchanger to remove the sludge particles. The sludge particles are removed from the flushing water outside the steam generator using filters, settling tanks, separator or a combination thereof. Depending upon the extent of the sludge and the amount and intensity of the desired applied pressure pulse, the time over which the pressure pulses are provided can range from approximately 1 hour to approximately 24 hours.

Another advantage of using the pressure pulse technique is that the spherical shock waves emitted can reflect off various surfaces of the heat exchanger tubes 32 to thereby clean the tubes from the rear as well as from the direct frontal impact of the shock wave. This facilitates the use of fewer Pressure Pulse Shock Wave Sources 80. While any type of air pressure generating source is within the spirit and scope of the present invention, it is preferred that the source emit a non-oxidizing gas such as nitrogen. In this way, oxygen will not be placed inside the steam generator 10. This is important because the oxygen will lead to corrosion of the steam generator components which is exactly the problem the present invention is addressing.

So far the present invention has been described with the use of an air source. It is also within the spirit and scope of the present invention to provide a Pressure Pulse Shock Wave Source from a water source or an electrical spark source. An air source, a water source and an electrical source are all usable with the present invention provided the source creates a shock wave or pressure pulse which travels radially outward from the source, thereby giving everything in its path a kick. The repetitions can be approximately once each second with the frequencies and pressures previously set forth.

So far, the present invention has been described as being used only with water which acts as a cap over the sludge pile 60. As previously mentioned, one advantage of the present invention is that it can be used without corrosive chemical which might damage the components of the steam generator 10. However, the present invention can be used with cleaning solvents and chemicals in conjunction with or else without the water. When used in conjunction with chemicals, the use of the repetitive shock wave or pressure pulse induced in the cleaning solvent, water or chemical, provides agitation to loosen and transport the corrosion deposit and to bring fresh solvent to the corrosion/solvent interface. The technique, therefore, can be used to remove heavily encrusted deposits such as magnetite from the junctions of the heat exchanger tubes 32 and their associated tube support plates 16. The pressure pulse or shock wave moves into and laterally of the junction between the tube support sheet and the heat exchanger tubes, to thereby remove used solvent and allow fresh chemical solvent to arrive at the junction to eat away at the encrusted magnetite.

Therefore, in summary, the present invention involves a method of removing the pile of sludge which settles on the tube sheet comprising, placing a Pressure Pulse Shock Wave Source into one or more of the multiplicity of hand holes, manways, drain lines and vents filling the steam generator with a liquid to a level above said pile of sludge, activating the Pressure Pulse Shock Wave Sources to generate a series of repetitive shock waves approximately once every second into the liquid and from the liquid into the pile of sludge, continuing the generation of repetitive shock waves which are generated with pressure between approximately 50 pounds per square inch and 5000 pounds per square inch which produce a range of frequencies between 0 Hertz and 1000 Hertz to create shock waves which produce a pressure level of approximately 1/100th to 100 Bars of Presure at 1 meter, continuing the shock wave impact for approximately 1 to 24 hours whereby the impact of the spherical shock waves serves to agitate and loosen the sludge and permits the sludge to remain in suspension, and flushing the steam generator with a liquid and vacuuming the steam generator to remove the liquid and carry the loosened sludge with it.

The above description of the present invention has concentrated on removing sludge from the bottom tube support sheet. The application of the above described present invention can also be used to remove sludge which has accumulated on top of the tube support plates 16. The same process is used but the liquid level is raised to several inches above the level of sludge to be removed. The Pressure Pulse Shock Wave Source may be correspondingly raised to strengthen the shock wave at the upper levels, but this may not be required. Similarly, the flushing water may be directed or channeled to the upper support plates to intensify the transport of the sludge from those areas.

Of course, the present invention is not intended to be restricted to any particular form or arrangement, or any specific embodiment disclosed herein, or any specific use, since the same may be modified in various particulars or relations without departing from the spirit or scope of the claimed invention herein above shown and described of which the method shown is intended only for illustration and for disclosure of an operative embodiment and not to show all of the various forms of modification in which the invention might be embodied.

The invention has been described in considerable detail in order to comply with the patent laws by providing a full public disclosure of at least one of its forms. However, such detailed description is not intended in any way to limit the broad features of principles of the invention, or the scope of patent monopoly to be granted.

What is claimed is:

1. A method of removing the products of corrosion, oxidation, sedimentation and comparable chemical reactions collectively known as sludge which settle on the bottom of a tube bundle heat exchanger and form a pile of sludge, the tube bundle heat exchanger characterized by a tube bundle heat exchanger wall and a thick metal plate known as a tube sheet near the lower portion of the tube bundle heat exchanger wall's interior surface, the tube sheet serving to support the lower ends of a multiplicity of heat exchanger tubes within the tube bundle heat exchanger, the tube bundle heat exchanger wall further comprising a multiplicity of small holes known as hand holes, manways, drain lines and vents, located around its circumference and above the tube sheet, the method of removing the pile of sludge which settles on the tube sheet comprising:

a. locating at least one air-gun type pressure pulse shock wave source outside the tube bundle heat exchanger so as to be able to introduce pressure pulse shock waves through one or more of the multiplicity of hand holes, manways, drain lines and vents;

b. filling said tube bundle heat exchanger with a liquid to a level above said pile of sludge;

c. activating the at least one air-gun type pressure pulse shock wave source to generate a repetitive series of explosive transient shock waves into said liquid and from said liquid into said pile of sludge such that the explosive transient shock waves and resultant liquid motion serve to agitate and loosen the sludge;

d. continuing the generation of repetitive, explosive, transient shock waves which are generated with pressure between approximately 50 pounds per square inch and 5000 pounds per square inch which result in energy predominantly in the frequency range between 1 Hertz and 1000 Hertz for each pulse to create transient shock waves which produce a pressure level of approximately 1/100th to 100 Bars in the liquid of Pressure at 1 meter;

e. continuing the shock wave impact for approximately 1 to 24 hours whereby the impact of the repetitive explosive transient shock waves and resultant liquid motion serves to mechanically agitate and move the sludge in the liquid; and f. draining the liquid from the heat exchanger and removing said at least one air-gun type pressure pulse shock wave source.

2. The invention as defined in claim 1 wherein said tube bundle heat exchanger is filled with liquid to a level approximately 12 inches above the pile of sludge.

3. The invention as defined in claim 1 wherein said liquid is water.

4. The invention as defined in claim 3 wherein said tube bundle heat exchanger is filled with water to a level approximately 12 inches above the pile of sludge.

5. The invention as defined in claim 1, comprising the further step of flushing the tube sheet with a liquid after the heat exchanger is drained to remove remaining debris.

6. The invention as defined in claim 1 wherein the continuing shock wave impact and repetitive explosive transient shock waves and resultant liquid motion serves to permit the sludge to remain in suspension in said liquid and the heat exchanger is continuously flushed with said liquid which is circulated through an external cleaning system to remove suspended and dissolved contaminants from said liquid before it is returned to the heat exchanger.

7. The invention as defined in claim 6 wherein the external cleaning of the liquid is accomplished by the method of filtering.

8. The invention as defined in claim 6 wherein the external cleaning of the liquid is accomplished by the method of ion-exchange.

9. The invention as defined in claim 1 wherein said liquid is a chemical solvent.

10. The invention as defined in claim 1 wherein said heat exchanger is a steam generator.

11. A method of removing the products of corrosion, oxidation, sedimentation and comparable chemical reactions collectively known as sludge which settle on the bottom of a tube bundle heat exchanger and form a pile of sludge, the tube bundle heat exchanger characterized by a tube bundle heat exchanger wall and a thick metal plate known as a tube sheet near the lower portion of the tube bundle heat exchanger wall's interior surface, the tube sheet serving to support the lower ends of a multiplicity of heat exchanger tubes within the tube bundle heat exchanger, the tube bundle heat exchanger wall further comprising a multiplicity of small holes known as hand holes, manways, drain lines and vents, located around its circumference and above the tube sheet, the method of removing the pile of sludge which settles on the tube sheet comprising:

a. introducing at least one air-gun type pressure pulse shock wave source through one or more of the multiplicity of hand holes, manways, drain lines and vents such that the at least one air-gun type pressure pulse shock wave source is located inside the tube bundle heat exchanger;
b. filling said tube bundle heat exchanger with a liquid to a level above said pile of sludge;
c. activating the at least one air-gun type pressure pulse shock wave source to generate a repetitive series of explosive transient shock waves into said liquid and from said liquid into said pile of sludge such that the explosive transient shock waves and resultant liquid motion serve to agitate and loosen the sludge;
d. continuing the generation of repetitive, explosive, transient shock waves which are generated with pressure between approximately 50 pounds per square inch and 5000 pounds per square inch which result in energy predominantly in the frequency range between 1 Hertz and 1000 Hertz for each pulse to create transient shock waves which produce a pressure level of approximately 1/100th to 100 Bars in the liquid of Pressure at 1 meter;
e. continuing the shock wave impact for approximately 1 to 24 hours whereby the impact of the repetitive explosive transient shock waves and resultant liquid motion serves to mechanically agitate and move the sludge in the liquid; and
f. draining the liquid from the heat exchanger and removing said at least one air-gun type pressure pulse shock wave source.

12. The invention as defined in claim 11 wherein said tube bundle heat exchanger is filled with liquid to a level approximately 12 inches above the pile of sludge.

13. The invention as defined in claim 11 wherein said liquid is water.

14. The invention as defined in claim 13 wherein said tube bundle heat exchanger is filled with water to a level approximately 12 inches above the pile of sludge.

15. The invention as defined in claim 11, comprising the further step of flushing the tube sheet with a liquid after the heat exchanger is drained to remove remaining debris.

16. The invention as defined in claim 11 wherein the continuing shock wave impact and repetitive explosive transient shock waves and resultant liquid motion serves to permit the sludge to remain in suspension in the liquid and the heat exchanger is continuously flushed with said liquid which is circulated through an external cleaning system to remove suspended and dissolved contaminants from the liquid before it is returned to the heat exchanger.

17. The invention as defined in claim 16 wherein the external cleaning of the liquid is accomplished by the method of filtering.

18. The invention as defined in claim 16 wherein the external cleaning of the liquid is accomplished by the method of ion-exchange.

19. The invention as defined in claim 11 wherein said liquid is a chemical solvent.

20. The invention as defined in claim 11 wherein said heat exchanger is a steam generator.

21. A method of removing the products of corrosion, oxidation, sedimentation and comparable chemical reactions collectively known as sludge which settle on the tube support plates of a tube bundle heat exchanger and form a pile of sludge, the tube bundle heat exchanger characterized by a tube bundle heat exchanger wall and a series of tube support plates arranged transverse to and sequentially spaced along the longitudinal axis of a multiplicity of heat exchanger tubes and forming junctions therewith, the tube bundle heat exchanger further characterized by a thick metal plate known as a tube sheet near the lower portion of the heat exchanger wall, the tube sheet serving to support the lower ends of the heat exchanger tubes, the tube bundle heat exchanger wall further comprising a multiplicity of small holes known as hand holes, manways, drain lines and vents, located around its circumference and along the height of the tube bundle heat exchanger, the method of removing the pile of sludge which settles on the tube support plates and the junctions between the heat exchanger tubes and the tube support plates, comprising:

a. locating at least one air-gun type pressure pulse shock wave source outside the tube bundle heat exchanger so as to be able to introduce pressure pulse waves through one or more of the multiplicity of hand holes, manways, drain lines and vents;
b. filling said tube bundle heat exchanger with a liquid to a level at or above said tube support plate to be cleaned;
c. activating the at least one air-gun type pressure pulse shock wave source to generate a repetitive series of explosive transient shock waves into said liquid and from said liquid into said pile of sludge and into the junctions between the tube support plate and the heat exchanger tubes such that the explosive transient shock waves and resultant liquid motion serve to agitate and loosen the sludge;
d. continuing the generation of repetitive, explosive, transient shock waves which are generated with pressure between approximately 50 pounds per square inch and 5000 pounds per square inch which result in energy predominantly in the frequency range between 1 Hertz and 1000 Hertz for each pulse to create transient shock waves which produce a pressure level of approximately 1/100th to 100 Bars in the liquid of Pressure at 1 meter; and
e. continuing the shock wave impact for approximately 1 to 24 hours whereby the impact of the repetitive explosive transient shock waves and resultant liquid motion serves to mechanically agitate and move the sludge in the liquid.

22. The invention as defined in claim 21 comprising the further step of draining the liquid from the heat exchanger and removing said at least one air-gun type pressure pulse shock wave source.

23. The invention as defined in claim 21 wherein said tube bundle heat exchanger is filled with liquid and the level of liquid is selectively varied.

24. The invention as defined in claim 21 wherein said liquid is water.

25. The invention as defined in claim 22, comprising the further step of flushing the tube sheet with a liquid after the heat exchanger is drained to remove remaining debris.

26. The invention as defined in claim 21 wherein the continuing shock wave impact and repetitive explosive transient shock waves and resultant liquid motion serves to permit the sludge to remain in suspension in said liquid and the heat exchanger is continuously flushed with said liquid which is circulated through an external cleaning system to remove suspended and dissolved contaminants from said liquid before it is returned to the heat exchanger.

27. The invention as defined in claim 26 wherein the external cleaning of the liquid is accomplished by the method of filtering.

28. The invention as defined in claim 26 wherein the external cleaning of the liquid is accomplished by the method of ion-exchange.

29. The invention as defined in claim 21 wherein said liquid is a chemical solvent.

30. The invention as defined in claim 21 wherein said heat exchanger is a steam generator.

31. A method of removing the products of corrosion, oxidation, sedimentation and comparable chemical reactions collectively known as sludge which settle on the tube support plates of a tube bundle heat exchanger and form a pile of sludge, the tube bundle heat exchanger characterized by a tube bundle heat exchanger wall and a series of tube support plates arranged transverse to and sequentially spaced along the longitudinal axis of a multiplicity of heat exchanger tubes and forming junctions therewith, the tube bundle heat exchanger further characterized by a thick metal plate known as a tube sheet near the lower portion of the heat exchanger wall, the tube sheet serving to support the lower ends of the heat exchanger tubes, the tube bundle heat exchanger wall further comprising a multiplicity of small holes known as hand holes, manways, drain lines and vents, located around its circumference and along the height of the tube bundle heat exchanger, the method of removing the pile of sludge which settles on the tube support plates and the junctions between the heat exchanger tubes and the tube support plates, comprising:

a. introducing at least one air-gun type pressure pulse shock wave source through one or more of the multiplicity of hand holes, manways, drain lines and vents such that the at least one air-gun type pressure pulse shock wave source is located inside the tube bundle heat exchanger;
b. filling said tube bundle heat exchanger with a liquid to a level at or above said tube support plate to be cleaned;
c. activating the at least one air-gun type pressure pulse shock wave source to generate a repetitive series of explosive transient shock waves into said liquid and from said liquid into said pile of sludge and into the junctions between the tube support plate and the heat exchanger tubes such that the explosive transient shock waves and resultant liquid motion serve to agitate and loosen the sludge;
d. continuing the generation of repetitive, explosive, transient shock waves which are generated with pressure between approximately 50 pounds per square inch and 5000 pounds per square inch which result in energy predominantly in the frequency range between 1 Hertz and 1000 Hertz for each pulse to create transient shock waves which produce a pressure level of approximately 1/100th to 100 Bars in the liquid of Pressure at 1 meter; and
e. continuing the shock wave impact for approximately 1 to 24 hours whereby the impact of the repetitive explosive transient shock waves and resultant liquid motion serves to mechanically agitate and move the sludge in the liquid.

32. The invention as defined in claim 31 comprising the further step of draining the liquid from the heat exchanger and removing said at least one air-gun type pressure pulse shock wave source.

33. The invention as defined in claim 31 wherein said tube bundle heat exchanger is filled with liquid and the level of liquid is selectively varied.

34. The invention as defined in claim 31 wherein said liquid is water.

35. The invention as defined in claim 32, comprising the further step of flushing the tube sheet with a liquid after the heat exchanger is drained to remove remaining debris.

36. The invention as defined in claim 31 wherein the continuing shock wave impact and repetivie explosive transient shock waves and resultant liquid motion serves to permit the sludge to remain in suspension in said liquid and the heat exchanger is continuously flushed with said liquid which is circulated through an external cleaning system to remove suspended and dissolved contaminants from the liquid before it is returned to the heat exchanger.

37. The invention as defined in claim 36 wherein the external cleaning of the liquid is accomplished by the method of filtering.

38. The invention as defined in claim 36 wherein the external cleaning of the liquid is accomplished by the method of ion-exchange.

39. The invention as defined in claim 31 wherein said liquid is a chemical solvent.

40. The invention as defined in claim 31 wherein said heat exchanger is a steam generator.

41. A method of removing the products of corrosion, oxidation, sedimentation and comparable chemical reactions collectively known as sludge which settle on the bottom of a tube bundle heat exchanger and form a pile of sludge, the tube bundle heat exchanger characterized by a tube bundle heat exchanger wall and a thick metal plate known as a tube sheet near the lower portion of the tube bundle heat exchanger wall's interior surface, the tube sheet serving to support the lower ends of a multiplicity of heat exchanger tubes within the tube bundle heat exchanger, the tube bundle heat exchanger wall further comprising a multiplicity of small holes known as hand holes, manways, drain lines and vents, located around its circumference and above the tube sheet, the method of removing the pile of sludge which settles on the tube sheet comprising:

a. locating at least one pressurized gas-type pressure pulse shock wave source outside the tube bundle heat exchanger so as to be able to introduce pressure pulse shock waves through one or more of the multiplicity of hand holes, manways, drain lines and vents;
b. filling said tube bundle heat exchanger with a liquid to a level above said pile of sludge;
c. activating the at least one pressurized gas-type pressure pulse shock wave source to generate a repetitive series of explosive transient shock waves into said liquid and from said liquid into said pile of sludge such that the explosive transient shock waves and resultant liquid motion serve to agitate and loosen the sludge;
d. continuing the generation of repetitive, explosive, transient shock waves which are generated with pressure between approximately 50 pounds per square inch and 5000 pounds per square inch which result in energy predominantly in the frequency range between 1 Hertz and 1000 Hertz for each pulse to create transient shock waves which produce a pressure level of approximately 1/100th to 100 Bars in the liquid of Pressure at 1 meter;

e. continuing the shock wave impact for approximately 1 to 24 hours whereby the impact of the repetitive explosive transient shock waves and resultant liquid motion serves to mechanically agitate and move the sludge in the liquid; and f. draining the liquid from the heat exchanger and removing said at least one pressurized gas-type pressure pulse shock wave source.

42. The invention as defined in claim 41 wherein said tube bundle heat exchanger is filled with liquid to a level approximately 12 inches above the pile of sludge.

43. The invention as defined in claim 41 wherein said liquid is water.

44. The invention as defined in claim 43 wherein said tube bundle heat exchanger is filled with water to a level approximately 12 inches above the pile of sludge.

45. The invention as defined in claim 41, comprising the further step of flushing the tube sheet with a liquid after the heat exchanger is drained to remove remaining debris.

46. The invention as defined in claim 41 wherein the continuing shock wave impact and repetitive explosive transient shock waves and resultant liquid motion serves to permit the sludge to remain in suspension in said liquid and the heat exchanger is continuously flushed with said liquid which is circulated through an external cleaning system to remove suspended and dissolved contaminants from said liquid before it is returned to the heat exchanger.

47. The invention as defined in claim 46 wherein the external cleaning of the liquid is accomplished by the method of filtering.

48. The invention as defined in claim 46 wherein the external cleaning of the liquid is accomplished by the method of ion-exchange.

49. The invention as defined in claim 41 wherein said liquid is a chemical solvent.

50. The invention as defined in claim 41 wherein said heat exchanger is a steam generator.

51. A method of removing the products of corrosion, oxidation, sedimentation and comparable chemical reactions collectively known as sludge which settle on the bottom of a tube bundle heat exchanger and form a pile of sludge, the tube bundle heat exchanger characterized by a tube bundle heat exchanger wall and a thick metal plate known as a tube sheet near the lower portion of the tube bundle heat exchanger wall's interior surface, the tube sheet serving to support the lower ends of a multiplicity of heat exchanger tubes within the tube bundle heat exchanger, the tube bundle heat exchanger wall further comprising a multiplicity of small holes known as hand holes, manways, drain lines and vents, located around its circumference and above the tube sheet, the method of removing the pile of sludge which settles on the tube sheet comprising:

a. introducing at least one pressurized gas-type pressure pulse shock wave source through one or more of the multiplicity of hand holes, manways, drain lines and vents such that the at least one pressurized gas-type pressure pulse shock wave source is located inside the tube bundle heat exchanger;

b. filling said tube bundle heat exchanger with a liquid to a level above said pile of sludge;

c. activating the at least one pressurized gas-type pressure pulse shock wave source to generate a repetitive series of explosive transient shock waves into said liquid and from said liquid into said pile of sludge such that the explosive transient shock waves and resultant liquid motion serve to agitate and loosen the sludge;

d. continuing the generation of repetitive, explosive, transient shock waves which are generated with pressure between approximately 50 pounds per square inch and 5000 pounds per square inch which result in energy predominantly in the frequency range between 1 Hertz and 1000 Hertz for each pulse to create transient shock waves which produce a pressure level of approximately 1/100th to 100 Bars in the liquid of Pressure at 1 meter;

e. continuing the shock wave impact for approximately 1 to 24 hours whereby the impact of the repetitive explosive transient shock waves and resultant liquid motion serves to mechanically agitate and move the sludge in the liquid; and f. draining the liquid from the heat exchanger and removing said at least one pressurized gas-type pressure pulse shock wave source.

52. The invention as defined in claim 51 wherein said tube bundle heat exchanger is filled with liquid to a level approximately 12 inches above the pile of sludge.

53. The invention as defined in claim 51 wherein said liquid is water.

54. The invention as defined in claim 53 wherein said tube bundle heat exchanger is filled with water to a level approximately 12 inches above the pile of sludge.

55. The invention as defined in claim 51, comprising the further step of flushing the tube sheet with a liquid after the heat exchanger is drained to remove remaining debris.

56. The invention as defined in claim 51 wherein the continuing shock wave impact and repetitive explosive transient shock waves and resultant liquid motion serves to permit the sludge to remain in suspension in said liquid and the heat exchanger is continuously flushed with said liquid which is circulated through an external cleaning system to remove suspended and dissolved contaminants from said liquid before it is returned to the heat exchanger.

57. The invention as defined in claim 56 wherein the external cleaning of the liquid is accomplished by the method of filtering.

58. The invention as defined in claim 56 wherein the external cleaning of the liquid is accomplished by the method of ion-exchange.

59. The invention as defined in claim 51 wherein said liquid is a chemical solvent.

60. The invention as defined in claim 51 wherein said heat exchanger is a steam generator.

61. A method of removing the products of corrosion, oxidation, sedimentation and comparable chemical reactions collectively known as sludge which settle on the tube support plates of a tube bundle heat exchanger and form a pile of sludge, the tube bundle heat exchanger characterized by a tube bundle heat exchanger wall and a series of tube support plates arranged transverse to and sequentially spaced along the longitudinal axis of a multiplicity of heat exchanger tubes and forming junctions therewith, the tube bundle heat exchanger further characterized by a thick metal plate known as a tube sheet near the lower portion of the heat exchanger wall, the tube sheet serving to support the lower ends of the heat exchanger tubes, the tube bundle heat exchanger wall further comprising a multiplicity of small holes known as hand holes, manways, drain lines and vents, located around its circumference and along the height of the tube bundle heat exchanger, the method of removing the pile of sludge which settles on the tube support plates and the junctions between the heat exchanger tubes and the tube support plates, comprising:

a. locating at least one pressurized gas-type pressure pulse shock wave source outside the tube bundle heat exchanger so as to be able to introduce pressure pulse shock waves through one or more of the multiplicity of hand holes, manways, drain lines and vents;

b. filling said tube bundle heat exchanger with a liquid to a level at or above said tube support plate to be cleaned;

c. activating the at least one pressurized gas-type pressure pulse shock wave source to generate a repetitive series of explosive transient shock waves into said liquid and from said liquid into said pile of sludge and into the junctions between the tube support plate and the heat exchanger tubes such that the explosive transient shock waves and resultant liquid motion serve to agitate and loosen the sludge;

d. continuing the generation of repetitive, explosive, transient shock waves which are generated with pressure between approximately 50 pounds per square inch and 5000 pounds per square inch which result in energy predominantly in the frequency range between 1 Hertz and 1000 Hertz for each pulse to create transient shock waves which produce a pressure level of approximately 1/100th to 100 Bars in the liquid of Pressure at 1 meter; and e. continuing the shock wave impact for approximately 1 to 24 hours whereby the impact of the repetitive explosive transient shock waves and resultant liquid motion serves to mechanically agitate and move the sludge in the liquid.

62. The invention as defined in claim 61 comprising the further step of draining the liquid from the heat exchanger and removing said at least one pressurized gas-type pressure pulse shock wave source.

63. The invention as defined in claim 61 wherein said tube bundle heat exchanger is filled with liquid and the level of liquid is selectively varied.

64. The invention as defined in claim 61 wherein said liquid is water.

65. The invention as defined in claim 62, comprising the further step of flushing the tube sheet with a liquid after the heat exchanger is drained to remove remaining debris.

66. The invention as defined in claim 61 wherein the continuing shock wave impact and repetitive explosive transient shock waves and resultant liquid motion serves to permit the sludge to remain in suspension the the liquid and the heat exchanger is continuously flushed with said liquid which is circulated through an external cleaning system to remove suspended and dissolved contaminants from said liquid before it is returned to the heat exchanger.

67. The invention as defined in claim 66 wherein the external cleaning of the liquid is accomplished by the method of filtering.

68. The invention as defined in claim 66 wherein the external cleaning of the liquid is accomplished by the method of ion-exchange.

69. The invention as defined in claim 61 wherein said liquid is a chemical solvent.

70. The invention as defined in claim 61 wherein said heat exchanger is a steam generator.

71. A method of removing the products of corrosion, oxidation, sedimentation and comparable chemical reactions collectively known as sludge which settle on the tube support plates of a tube bundle heat exchanger and form a pile of sludge, the tube bundle heat exchanger characterized by a tube bundle heat exchanger wall and a series of tube support plates arranged transverse to and sequentially spaced along the longitudinal axis of a multiplicity of heat exchanger tubes and forming junctions therewith, the tube bundle heat exchanger further characterized by a thick metal plate known as a tube sheet near the lower portion of the heat exchanger wall, the tube sheet serving to support the lower ends of the heat exchanger tubes, the tube bundle heat exchanger wall further comprising a multiplicity of small holes known as hand holes, manways, drain lines and vents, located around its circumference and along the height of the tube bundle heat exchanger, the method of removing the pile of sludge which settles on the tube support plates and the junctions between the heat exchanger tubes and the tube support plates, comprising:

a. introducing at least one pressurized gas-type pressure pulse shock wave source through one or more of the multiplicity of hand holes, manways, drain lines and vents such that the at least one pressurized gas-type pressure pulse shock wave source is located inside the tube bundle heat exchanger;

b. filling said tube bundle heat exchanger with a liquid to a level at or above said tube support plate to be cleaned;

c. activating the at least one pressurized gas-type pressure pulse shock wave source to generate a repetitive series of explosive transient shock waves into said liquid and from said liquid into said pile of sludge and into the junctions between the tube support plate and the heat exchanger tubes such that the explosive transient shock waves and resultant liquid motion serve to agitate and loosen the sludge;

d. continuing the generation of repetitive, explosive, transient shock waves which are generated with pressure between approximately 50 pounds per square inch and 5000 pounds per square inch which result in energy predominantly in the frequency range between 1 Hertz and 1000 Hertz for each pulse to create transient shock waves which produce a pressure level of approximately 1/100th to 100 Bars in the liquid of Pressure at 1 meter; and e. continuing the shock wave impact for approximately 1 to 24 hours whereby the impact of the repetitive explosive transient shock waves and resultant liquid motion serves to mechanically agitate and move the sludge in the liquid.

72. The invention as defined in claim 71 comprising the further step of draining the liquid from the heat exchanger and removing said at least one pressurized gas-type pressure pulse shock wave source.

73. The invention as defined in claim 71 wherein said tube bundle heat exchanger is filled with liquid and the level of liquid is selectively varied.

74. The invention as defined in claim 71 wherein said liquid is water.

75. The invention as defined in claim 72, comprising the further step of flushing the tube sheet with a liquid after the heat exchanger is drained to remove remaining debris.

76. The invention as defined in claim 71 wherein the continuing shock wave impact and repetitive transient shock waves and resultant liquid motion serves to permit the sludge to remain in suspension in the liquid and the heat exchanger is continuously flushed with said liquid which is circulated through an external cleaning system to remove suspended and dissolved contaminants from the liquid before it is returned to the heat exchanger.

77. The invention as defined in claim 76 wherein the external cleaning of the liquid is accomplished by the method of filtering.

78. The invention as defined in claim 76 wherein the external cleaning of the liquid is accomplished by the method of ion-exchange.

79. The invention as defined in claim 71 wherein said liquid is a chemical solvent.

80. The invention as defined in claim 71 wherein said heat exchanger is a steam generator.

* * * * *